US009271614B2

(12) United States Patent
Rowles

(10) Patent No.: US 9,271,614 B2
(45) Date of Patent: Mar. 1, 2016

(54) UNIVERSAL BACK WASHING-MASSAGING UNIT

(75) Inventor: Steven V. Rowles, Ontario, CA (US)

(73) Assignee: Steven V. Rowles, Bullhead City, AZ (US)

( * ) Notice: Subject to any disclaimer, the term of this patent is extended or adjusted under 35 U.S.C. 154(b) by 1028 days.

(21) Appl. No.: 12/152,399

(22) Filed: May 14, 2008

(65) Prior Publication Data

US 2011/0145986 A1 Jun. 23, 2011

Related U.S. Application Data

(60) Provisional application No. 60/961,913, filed on Jul. 25, 2007.

(51) Int. Cl.
*A47K 7/02* (2006.01)

(52) U.S. Cl.
CPC ..... *A47K 7/024* (2013.01)

(58) Field of Classification Search
USPC ..... 4/606, 605, 628, 661; 15/104.92, 160, 15/88.2
See application file for complete search history.

(56) References Cited

U.S. PATENT DOCUMENTS

| | | | | |
|---|---|---|---|---|
| 2,730,737 | A * | 1/1956 | Herman | 15/88.2 |
| 3,862,459 | A | 1/1975 | Brunette | |
| 4,336,623 | A * | 6/1982 | Lin | 15/222 |
| 5,345,640 | A * | 9/1994 | Goss | 15/88.2 |
| 5,540,362 | A * | 7/1996 | Azuma et al. | 222/642 |
| 5,774,907 | A | 7/1998 | Doggwiler | |
| 6,174,296 | B1 * | 1/2001 | Wang | 601/114 |
| 6,996,861 | B1 * | 2/2006 | Clark, Jr. | 4/606 |
| 7,120,947 | B1 | 10/2006 | Magallanes | |
| 2003/0167565 | A1 * | 9/2003 | Yoshida | 4/606 |
| 2005/0229347 | A1 | 10/2005 | Dent D'Almuano | |
| 2006/0107473 | A1 * | 5/2006 | Torres | 15/21.1 |
| 2007/0022527 | A1 * | 2/2007 | Russo et al. | 4/606 |
| 2007/0182571 | A1 * | 8/2007 | Kennish et al. | 340/573.1 |

* cited by examiner

*Primary Examiner* — Lauren Crane
(74) *Attorney, Agent, or Firm* — Steven V. Rowles

(57) ABSTRACT

A portable back scrubbing and massaging device is provided that can be used in and out of the shower for effectively cleaning and massaging a back of an individual. The portable device has brushes that can be removed and replaced with other brushes or massage accessories. This permits an individual to select from a wide variety of brushes and massage accessories that have varying amounts of thickness, softness, firmness and/or length. The brushes can also be reconfigured into different arrangements or patterns that allows a person to get a cleaning or massage that matches the contours of that person's back.

9 Claims, 9 Drawing Sheets

UNIVERSAL BACK WASHING-MASSAGING UNIT

CROSS-REFERENCE TO RELATED APPLICATIONS

This application is based on U.S. Provisional Application No. 60/961,913, filed on Jul. 25, 2007, entitled "The Universal Back Washing-Massaging Unit", the contents of which are incorporated herein by reference.

FIELD OF THE INVENTION

This invention relates generally to body cleaning and massaging devices, and more particularly, to a portable device for scrubbing and massaging the back.

BACKGROUND OF THE INVENTION

Using brushes to clean a person's back is well known in the prior art. There are multiple prior art designs and brush configurations to accomplish cleaning a back in a shower. For example, a motorized back scrubber is disclosed in U.S. Pat. No. 5,345,640 which includes a number of rotating brushes powered by an electric motor to clean the back of an individual. In U.S. Pat. No. 6,996,861, another shower back cleansing and massaging device is disclosed. It hangs from the shower head and is adjustable to match the height of the individual taking a shower. The device has three separate sections of rotating brushes that cleans different areas of the back. Another back massaging and cleaning device is disclosed in U.S. Pat. No. 7,120,947 where the brushes are affixed to the device and do not move. Liquid soap and water is dispensed between the brushes to clean a person's back.

Previous back scrubbing devices were specifically designed to work solely in the shower. They lacked the ability to be used outside the shower as a massager or a cleaner. There is a need for a portable back scrubbing and massaging device that can be used safely in the shower and outside the shower, on a person's bed for example.

Previous brush configurations were unchangeable, meaning that the brushes could not be repositioned to suit the personal preferences of an individual. Predetermined brush configurations may not be suitable for all individuals, since each person may have a personal preference about what area or section of the back they want to clean. Thus, there is a need to have the brushes be configurable and removable, so that a person can rearrange the brushes into a configuration that suits their personal preference.

In previous back scrubbing devices, the brush heads were permanent and unalterable. This meant that an individual was unable to select a different brush other than those brushes provided. Also if the brush wore out, the complete back scrubbing device would have to be replaced. Since each person has varying sensitivities to different types of brushes, there then is a need for a back scrubbing and massaging device that lets a person choose from a variety of brushes and massage accessories with varying amounts of thickness, softness, or length to suit the person's personal preference.

SUMMARY OF THE INVENTION

In view of the foregoing disadvantages inherent in the prior art, the present invention provides a new portable back scrubbing and massaging device that can be used in and out of the shower for effectively cleaning and massaging a back of an individual. It has the advantage of having configurable brushes to provide a more personalized scrubbing or massaging experience than previously available. The brushes can be removed and replaced with other brushes or massage accessories. This permits an individual to select from a wide variety of brushes and massage accessories that have varying amounts of thickness, softness, firmness and/or length. The brushes can also be reconfigured into an array of different arrangements or patterns that allows a person to get an personalized cleaning or massaging that matches the contours of their back.

Other and further aspects and features of the invention will be evident from reading the following detailed description of the preferred embodiments, which are intended to illustrate and, not limit the invention.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DETAILED DESCRIPTION OF THE INVENTION

Figure 1:
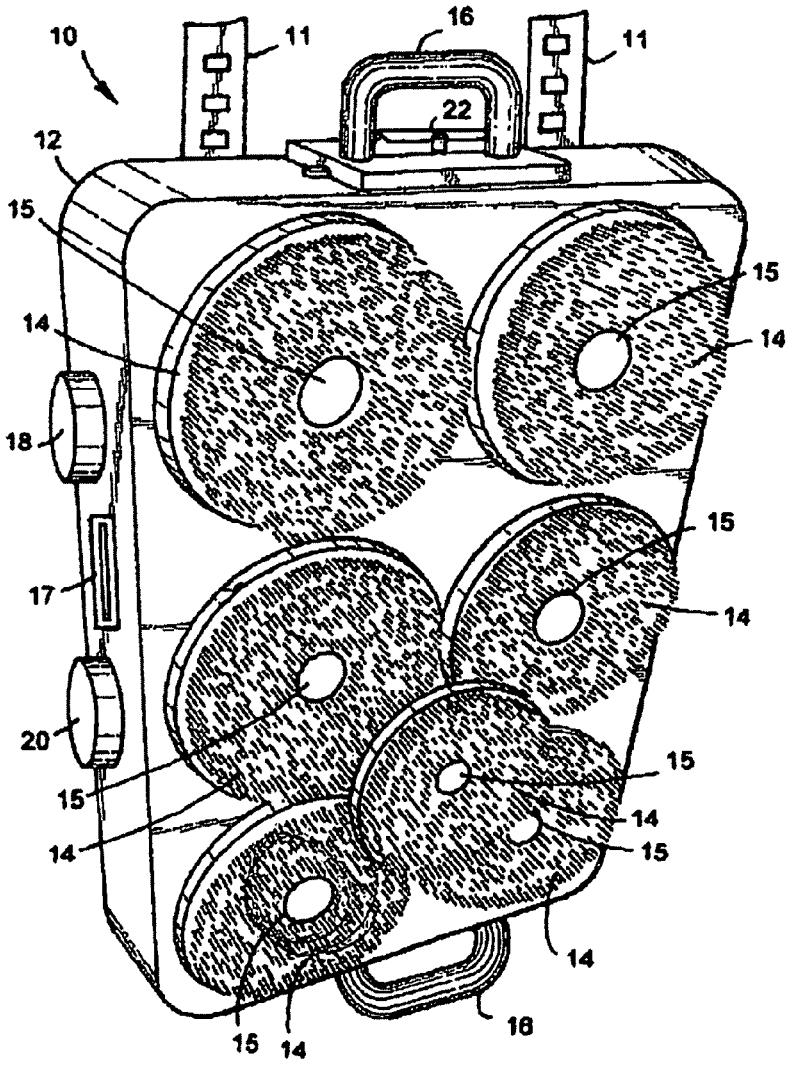
FIG. 1 is a front perspective view of the portable back scrubbing and massaging device according to the present invention.
Figure 1A:
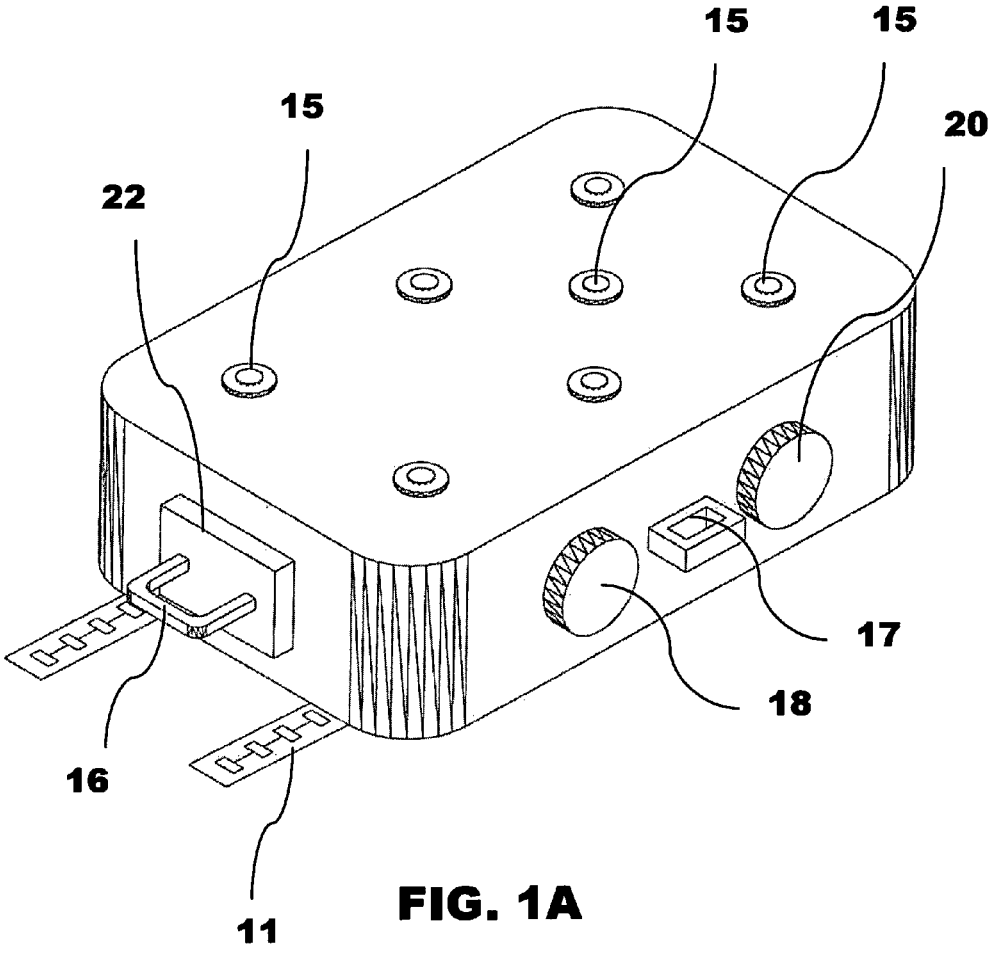
FIG. 1A shows a rear perspective view of the components of portable back scrubbing and massaging device according to the present invention Paragraph
Figure 2:
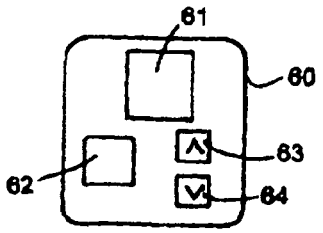
FIG. 2 shows a view of digital control unit according to the present invention.

FIG. 1 shows a front perspective view of the portable back scrubbing and massaging device 10 according to the present invention. The improved portable back scrubbing and massaging device 10 comprises a case 12, circular brushes 14, two handles 16, a strap slot 17, an on/off/speed dial 18, height adjustment knob 20, and refill cap 22. Although the case 12 is shown in FIG. 1 to be rectangular in shape, those skilled in the art can recognize that the case 12 can be one of any variety of shapes, including but not limited to square or circular, for example. The case 12 can be a green manufactured product from plastic, metal, or any other suitable materials for use in and out of the shower.

The portable back scrubbing and massaging device 10 is attached to the wall of a shower by using two brackets 11 and an interlocking mechanism (not shown in FIG. 1). The back of device 10 has a bracket interlocking mechanism that locks device 10 onto the brackets. Such bracket interlocking mechanism is commercially available. By turning the height adjustment knob 20 either clockwise or counter-clockwise, case 12 can be lowered or raised on the brackets. This permits a person to adjust the height of the device 10 to their particular height or preference. Pulling on the height adjustment knob 20 releases or unlocks the portable device 10 from the brackets. Device 10 can then be easily removed from the shower area by gripping the handles 16. Pushing on the knob 20 will lock the interlocking mechanism of device 10 onto the brackets.

In an alternative embodiment, device 10 can be attached to the wall of shower using suction cups 25, or any other attachment or connection technology known to those skilled in the art. When using suction cups 25, to adjust the height of the device 10, a person first would have to physically remove the case 12 from the wall by pulling on the handles 16 of case 12 to release the suctions cup 25. Then a person places the case 12 at the preferred height, and pushes on the handles 16 of case 12 so the suction cups 25 stick to the walls of the shower.

Figure 3:
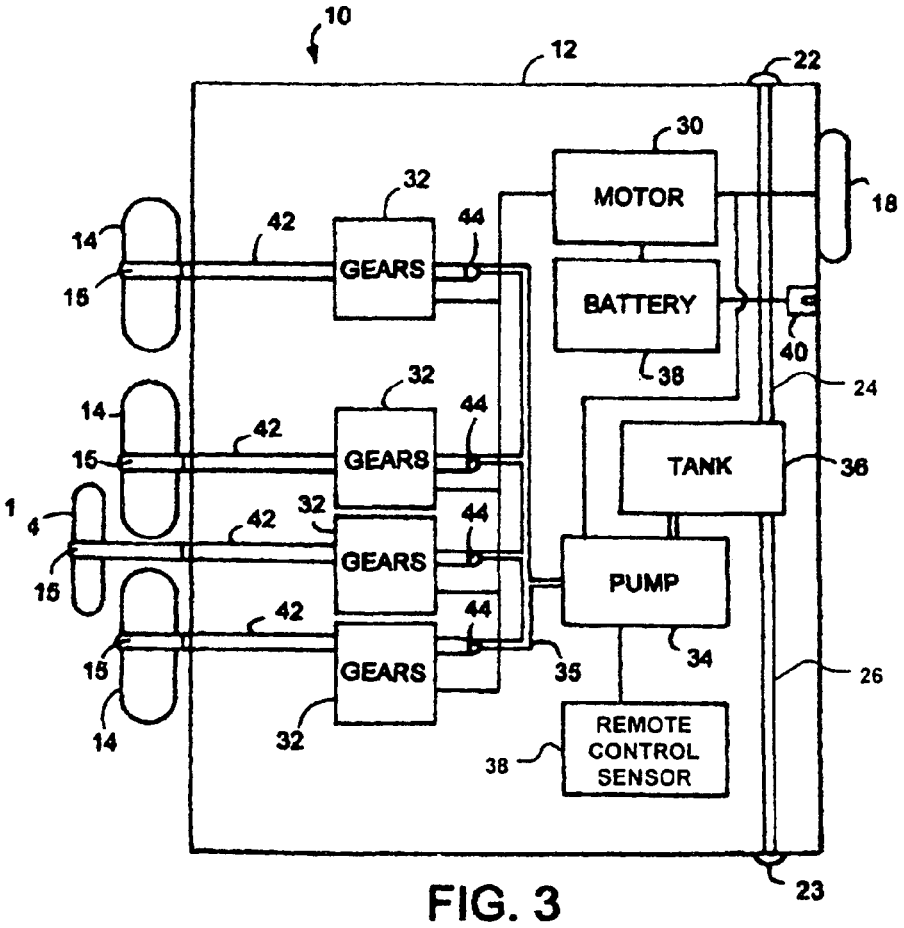
FIG. 3 shows a representational view of the components of portable back scrubbing and massaging device according to the present invention
Figure 7:
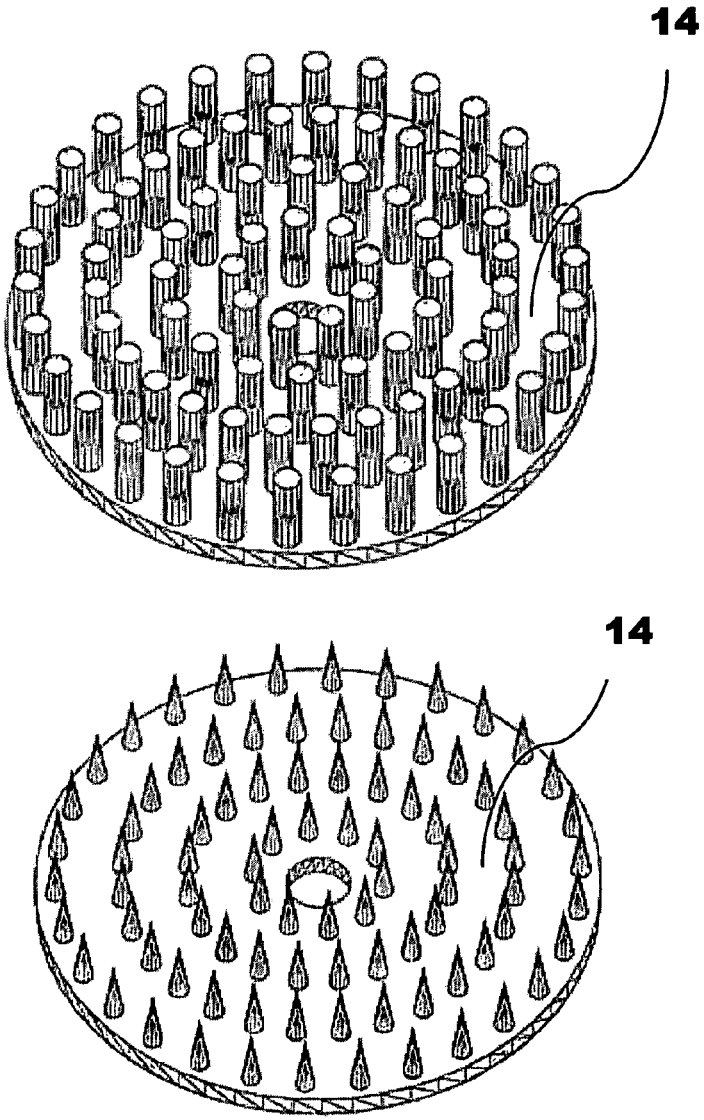
FIG. 7 shows an illustration of a generic version of brushes
Figure 8:
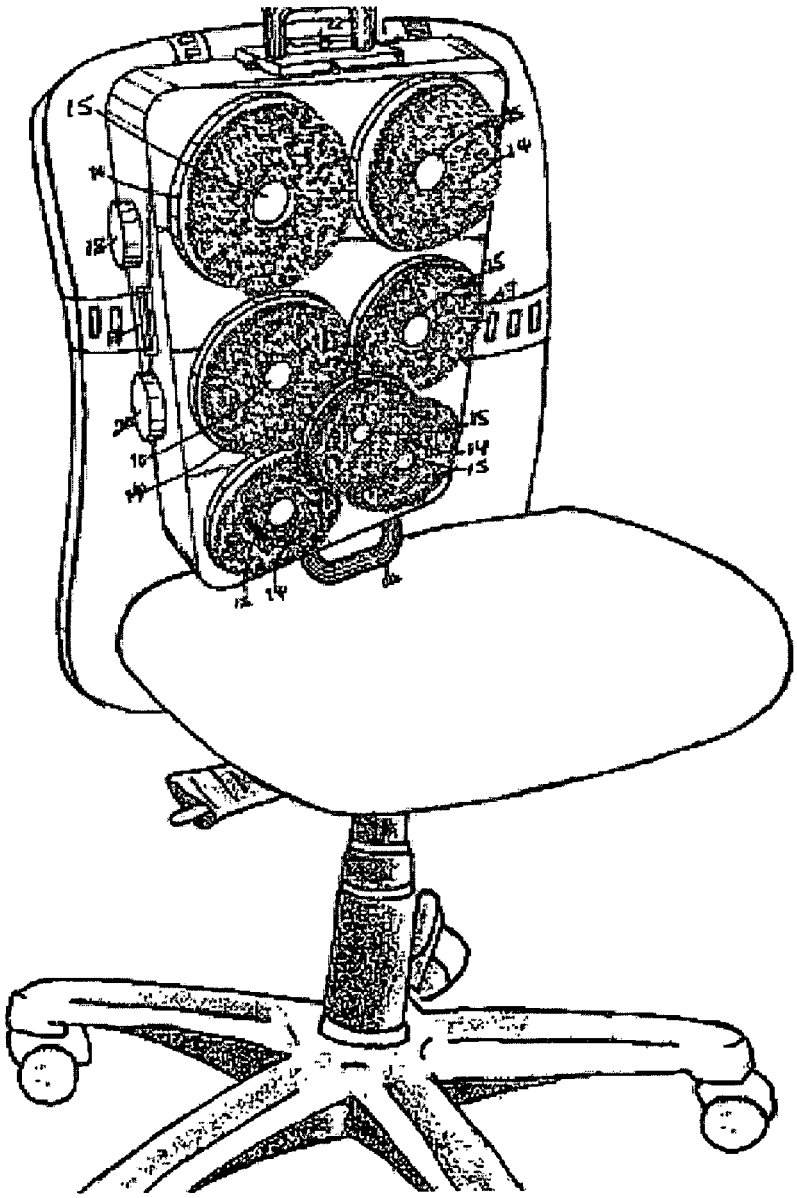
FIG. 8 shows a perspective view of the portable back scrubbing and massaging device being located on a generic chair.

Each of the circular brushes or accessories 14 shown in FIG. 1 & FIG. 7 attached to the device 10 via the snap lock which is attached to a shaft or post which extends from outside the case 12 through an opening in the case 12 where they engage, connect and/or mesh with the gears 32 (FIG. 3). The circular brushes 14 and the center of the brushes 15 rotate around an axis that extends along the protruding shaft.

Each of the snap locks, lock on to a brush 14 by any of the ways that are commercially available and known to those skilled in the art. For example, a brush 14 could be screwed onto the case 12. Alternatively, a brush 14 could be snap locked onto the case 12 by pushing the brush 14 on the case 12 until the snap lock is engaged. The brush 14 is released or unlocked where upon the brush 14 could be detached from the case 12.

Brushes 14 are removable and replaceable. Brushes 14 may be interchanged with other brushes having one of many different varieties of thickness, softness, firmness and/or length, for example, or interchanged with pads which are used for applying lotions and oils. Brushes 14 may additionally be interchanged with other massage accessories, such as hard plastic or rubber knobs 51, spheres, or pads 52 that would attach onto the case 12 Since device 10 is portable and can be used outside the shower, a person could use device 10 as a massaging device with rotating massage accessories, for example. Each of the brushes 14 having a substantially circular shape and that supports a number of brush fibers on an outward surface thereof. The brush fibers are each comprised of a substantially flexible material which is operable to comfortably and advantageously clean the back of a person's body.

Brushes 14 rotate either in the clockwise or counter-clockwise direction along the axis of the protruding shaft. In the preferred embodiment, brushes 14 rotate only in one direction The speed of the rotation of the brushes 14 is controlled by the speed dial 18 which in turns controls the speed of the motor 30 (FIG. 3). Speed dial 18 is also an on/off switch for turning motor 30 and thus device 10 on and off. Speed dial 18 also controls the pump 34 (FIG. 3) which regulates the amount of liquid that is dispensed from the center 15 of each of the brushes 14. Regardless of the speed of the rotation of the brushes 14, liquid soap, lotion or other liquid is evenly and proportionately dispensed by the pump.

In an alternative embodiment, device 10 may include another switch or dial that works in conjunction with speed dial 18 which permits the brushes 14 to rotate in either direction. In a further embodiment, device 10 could also have another switch or dial that would control the amount of liquid that is dispensed when the brushes are rotating. For example, more liquid could be dispensed by rotating the dial. In another alternative embodiment, dial 18 may be a remote control receptor unit, whereby a person could control the device 10 and the speed of the brushes 14 via remote control unit 39. In yet another alternative embodiment, some brushes 14 may rotate in one direction, while other brushes 14 rotate in the opposite direction. For example, the brushes 14 on the left side of the device 10 would rotate in the clockwise direction, while brushes 14 on the right side would rotate in the counter-clockwise direction.

Figure 2A:
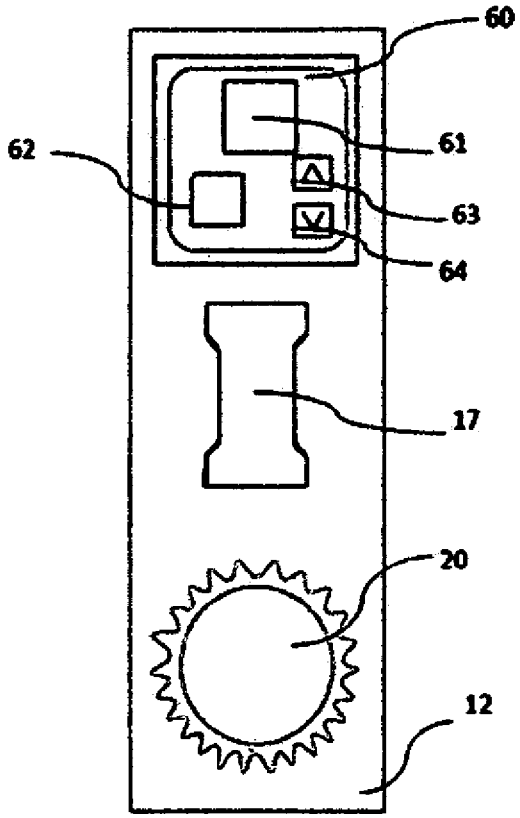
FIG. 2A shows a side view of the portable back scrubbing and massaging device according to the present invention.

Dial 18 is essentially a control unit for controlling the speed of the brushes and turning the device 10 on or off. As shown in FIG. 2A, dial 18 and dial 20 may be replaced with the digital control unit 60 shown in FIG. 2A. In this alternative embodiment, digital control unit 60 comprises a digital display 61, a function button 62, an up arrow button 63 and a down arrow button 64. The digital control unit 60 and buttons 62, 63, 64 would be water-proof. The digital display 61 may be any type of digital display that is commercially available, where it could show the different functions individually or in a list. A user could select the appropriate functions by pressing on the function button 62 in conjunction with the up arrow button 63 and down arrow button 64. For example, to turn the device 10 on, a user would select the on/off function by pressing on the function button 62, selecting the on/off function, and then selecting the up arrow button 63 or down arrow button 64 to turn the device 10 either on or off. Digital control unit 60 is able to control one or more functions of the device 10, for example: turning the device 10 on or off, adjusting the speed of rotation of the brushes, adjusting the rotation direction of the brushes (either as a single group or individually), moving the device 10 up or down along the brackets 11, and adjusting the flow rate of the soap from the device 10.

Figure 2B:
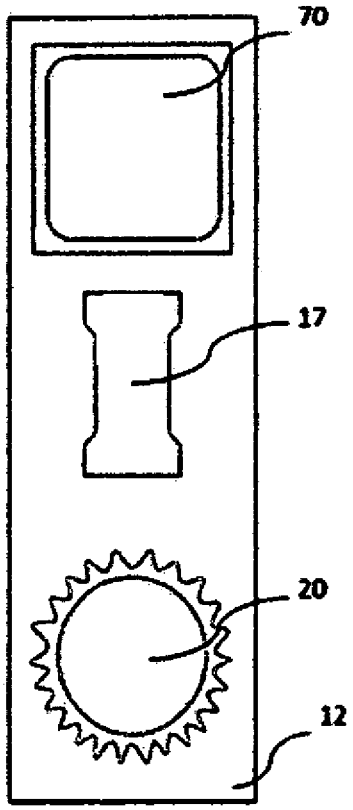
FIG. 2B shows a side view of the portable back scrubbing and massaging device according to the present invention.

In another alternative embodiment, dials 18 and 20 could be replaced by at least one touch screen 70, as shown in FIG. 2B, that would have the capabilities of being touched by a user to control the various functions of device 10. This touch screen digital unit would be water-proof. Instead of using the function button 62 and the up and down arrows 63, 64, the touch screen 70 would permit a user to select a particular function. The different choices of a particular function would be shown on the screen and the user would touch their selection to change the operation of device 10.

Figure 3A:
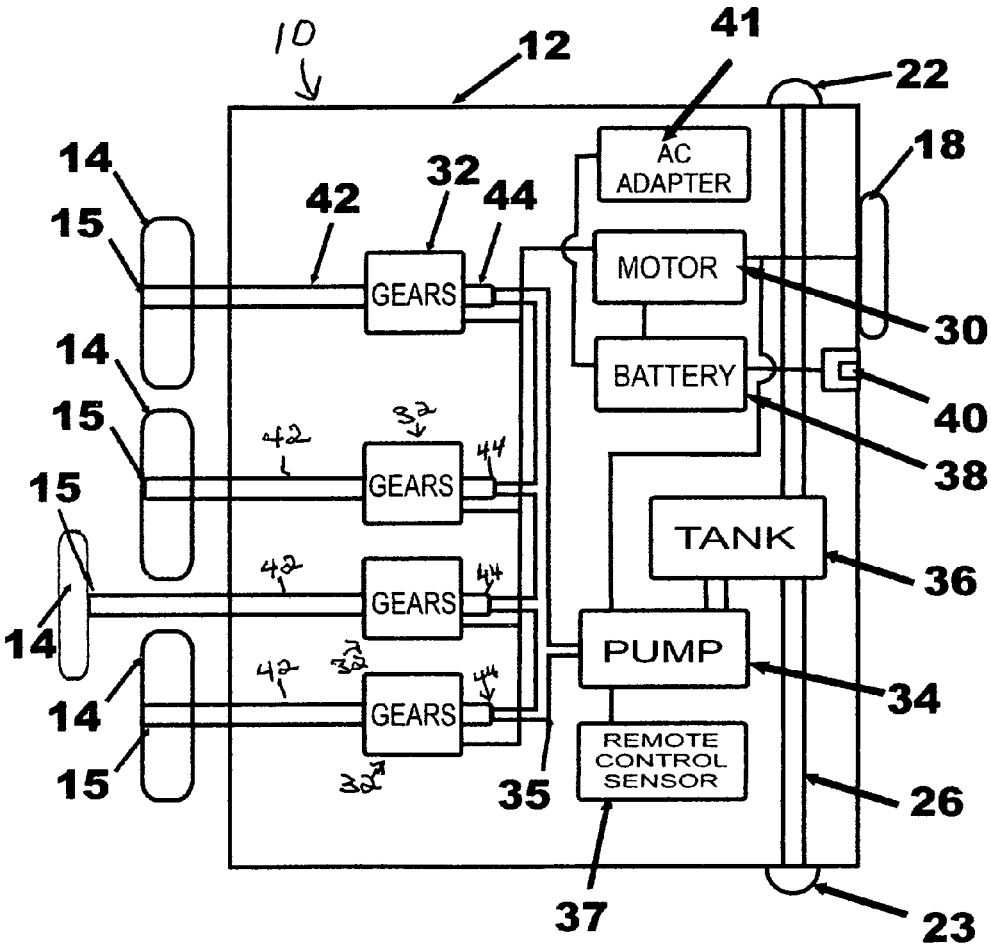
FIG. 3A shows a representational view of the components of portable back scrubbing and massaging device according to the present invention
Figure 4:
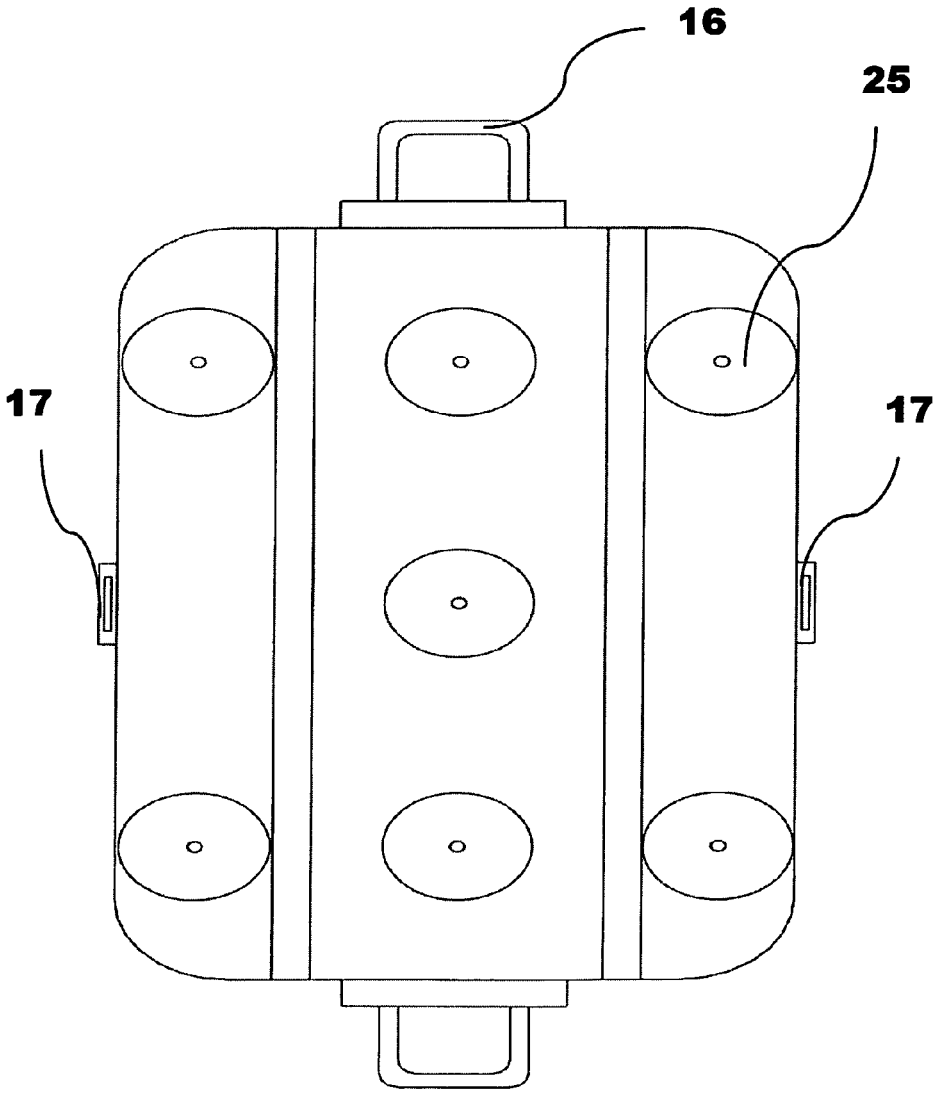
FIG. 4 shows a rear view of the components of portable back scrubbing and massaging device according to the present invention

In yet another embodiment, as shown in FIG. 2B, dials 18 and 20 could be replaced by a wired or wireless remote control system, or the remote control system may be used in conjunction with the dials 18 and 20, the digital control unit 60, or a touch screen 70. The remote control system would operate as known to those of ordinary skill in the art. The remote control system would comprise a remote control unit 39, as shown in FIG. 4, a remote control sensor 37, as shown in FIG. 3A (for wireless configurations) and a control unit. The remote control unit would have a variety of buttons or a touch screen for selecting one of the many functions of the device 10. The sensor would be able to send/receive the wireless signals to/from the remote control unit and relay the signals to the control unit. The control unit would control or distribute the appropriate signals to the different components of device 10 to control the various functions.

Since all of the brushes 14 are removable and replaceable, the brushes 14 can be reconfigured into a variety of different arrangements or patterns by excluding or including some of the brushes 14 or by having brushes with different sizes. For example, as shown in FIG. 1, there is one brush 14. This brush 14 can be removed so the portable scrubbing and massaging device 10 uses only six rotating brushes 14. Alternatively, the raised brush 14 could be replaced with a much larger brush, and the four brushes in the vicinity of the raised brush could be removed, resulting in device 10 having three brushes 14 (two above, and one large brush below). In another embodiment, all of the brushes except the lower, middle brush could be removed, resulting in the device 10 having only one rotating brush 14. for the alternative embodiments, a cap may be used to cap the center 15 where there is no brush 14 present. This prevents liquid from being dispensed when there is no brush or massage accessory present.

When the portable back scrubbing and massaging device 10 is used outside the shower, a strap can be attached to the strap slots 17 that are located on both sides of the device 10. The strap slots 17 are capable of holding a strap having a standard width of two inches. The strap would then be able to fasten or hold the device 10 onto the back of a chair, for example. In alternative embodiments, the strap slot 17 may be a hook, a ring, a D-clip or any of the other well known ways for attaching a strap onto the device 10. For example, the strap slot 17 may be replaced with a ring, while the strap would have a clip that would attach or clip onto the ring. Further the strap slots 17 may be any size or width to complement the size of the width of the strap being used.

FIG. 3 shows a representational view of the components of the portable back scrubbing and massaging device 10. As shown in FIG. 3, device 10 comprises brushes 14, the case 12, a dial 18, a refill cap 22, a draining cap 23, a refill tube 24, a draining tube 26, a motor 30, gears 32, a pump 34, a supply tube 35, a tank 36, a rechargeable battery 38, an alternating current (AC) electrical receptor 40, shafts 42, and connectors 44.

Each of the shafts 42 is mechanically coupled to a motorized gear 32 which is powered by an electric motor 30. The electric motor 30 also controls the speed or movement of the gears 32, and thus the speed of the rotation of the shafts 42 and the brushes 14. The motor 30 is coupled or connected to a rechargeable battery 38 to provide an energy source for powering the motor 30. The battery 38 is recharged via a AC adaptor 41, shown in FIG. 3 that plugs into an electrical socket in the wall and into an AC receptor 40 which is connected to the battery 38.

The device 10 is portable, and can be safely removed from the shower before recharging the battery 38. In an alternative embodiment, device 10 may include an AC power override switch that prohibits the motor 30 from operating when the battery 38 is being recharged and plugged into an AC outlet, or that prohibits the battery 38 from providing energy to the motor 30. This would provide an important safety feature to safeguard against accidental electrocution if a person tries to use the device 10 in the shower while it is being recharged.

A tank 36 is connected to a pump 34. The pump 34 is connected by a tube 35 to each of the ends of the hollow shafts 42 via a connector 44. The connector 44 permits a shaft 42 to rotate around an axis, but also keeps the tube 35 stationary. The shafts 42 will dispense the liquid from the tank 36 through the hollow shaft 42 to the center area 15 of each of the brushes 14.

The tank 36 can hold soap, oil, lotion or any other type of liquid. Tank 36 is filled with liquid through a tube 24 the extends from the opening covered by refill cap 22 located at the top of case 12 to the tank 36. The liquid in tank 36 can be drained by opening the cap 23 located at the bottom of case 12. A tube 26 extends from the tank 36 to the opening that is covered by the drain cap 23.

Once device 10 is operating and the motor 30 is running, the pump 34 takes the liquid stored in the tank 36 and provides a constant flow of liquid through the tube 35. The liquid then travels through the shafts 42, and then into an area of the center 15 of each of the brushes 14. The liquid then is ejected from center 15 on to the brushes 14. This provides liquid soap in combination with the brushes to scrub a person's back when the back engages the brushes 14.

As mentioned previously in an alternative embodiment, the pump 34 may be selectively operated by another dial which would allow the liquid soap to flow at an adjustable rate to each of the brushes 14. In this embodiment, a person would be able to select the amount of soap that is dispensed by the pump 34, rather than using the predetermined amount of soap that device 10 dispenses.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Although particular embodiments of the present inventions have been shown and described, it will be understood that it is not intended to limit the present inventions to the preferred embodiments. It will be obvious to those skilled in the art that various changes and modifications may be made without departing from the spirit and scope of the present inventions. Thus, the present inventions are intended to cover alternatives, modifications and equivalents, which may be included within the spirit and scope of the present inventions as defined herein.

What is claimed is:

1. A portable back scrubbing and massaging device consisting of:

a. a case with handles, and at least one strap slot on each opposing sides of said case, b. a motor secured in said case, c. a digital control unit that controls said motor, d. plurality of gears connected with said motor, e. plurality of shafts connected with said gears, f. plurality of center rings connected with said gears through said shafts, and g. plurality of detachable scrubbing and massaging accessories attached to said center rings;

h. a tank;

i. a pump coupled to said tank; and j. a tube coupled to said pump and to each of said shafts;

wherein, said motor is operable by rechargeable battery or an AC Adapter;

said tube is coupled to each of said gears through a connector;

said shafts are connected to motor through gears in a manner such that said scrubbing and massaging accessories rotate in a clockwise as well as counter clockwise direction; and wherein said device is used for scrubbing a user inside of the shower and massaging a user outside of the shower.

2. The device as claimed in claim 1 wherein the tank is coupled to plurality of tubes, including a first refill tube having an opening in, and extending from the top of the case to said tank and a draining tube extending from said tank and having an opening in the bottom of said case, wherein, a removable refill cap covers said opening in said first refill tube and a removable drain cap covers said opening in said draining tube.

3. The device as claimed in claim 1, wherein the said detachable scrubbing and massaging accessories include but not limited to plastic spheres, rubber spheres, and pads.

4. The device as claimed in claim 1, wherein said rechargeable battery is capable of being recharged outside shower or bath.

5. The device as claimed in claim 1, wherein the digital control unit is controlled by a remote control unit.

6. The device as claimed in claim 1, wherein the digital control unit is controlled by a digital touch screen permitting function to be shown on said screen allowing user to control the device by touching said screen.

7. The device as claimed in claim 1, wherein said handles on said case allows user to remove the device from a shower wall and make said device portable and usable as a massager outside of the shower.

8. The device as claimed in claim 1, wherein said strap slot allows said device to be strapped to a chair.

9. A portable back scrubbing and massaging device consisting of:

a. a case with handles, at least one bracket, and at least one strap slot on each opposing sides of said case, b. a motor secured in said case, c. a digital control unit that controls said motor, d. plurality of gears connected with said motor, e. plurality of shafts connected with said gears, f. plurality of center rings connected with said gears through said shafts, and g. plurality of detachable scrubbing and massaging accessories attached to said center rings;

h. a tank;

i. a pump coupled to said tank; and j. a tube coupled to said pump and to each of said shafts;

wherein, said bracket is used for attaching and detaching said device onto and from any wall;

said motor is operable by rechargeable battery or an AC Adapter;

said tube is coupled to each of said gears through a connector;

said shafts are connected to motor through gears in a manner such that said scrubbing and massaging accessories rotate in a clockwise as well as counter clockwise direction; and wherein said device is used for scrubbing a user inside of the shower and massaging a user outside of the shower.

* * * * *

UNITED STATES PATENT AND TRADEMARK OFFICE

CERTIFICATE OF CORRECTION

PATENT NO. : 9,271,614 B2
APPLICATION NO. : 12/152399
DATED : March 1, 2016
INVENTOR(S) : Steven V. Rowles It is certified that error appears in the above-identified patent and that said Letters Patent is hereby corrected as shown below:

On the title page, under abstract "9 Claims, 9 Drawing Sheets" should read, --9 Claims, 10 Drawing Sheets--.

In the Drawings

Drawings for Figures 2A and Figure 2B was not included in the issued Patent. (see attached)

In the Specification

Column 2, Line 33, should read, Figure 2A shows the side view of the portable back scrubbing and massaging device according to the present invention.

Column 2, Line 34, should read, Figure 2B shows the side view of the portable back scrubbing and massaging device according to the present invention.

Figure 6:
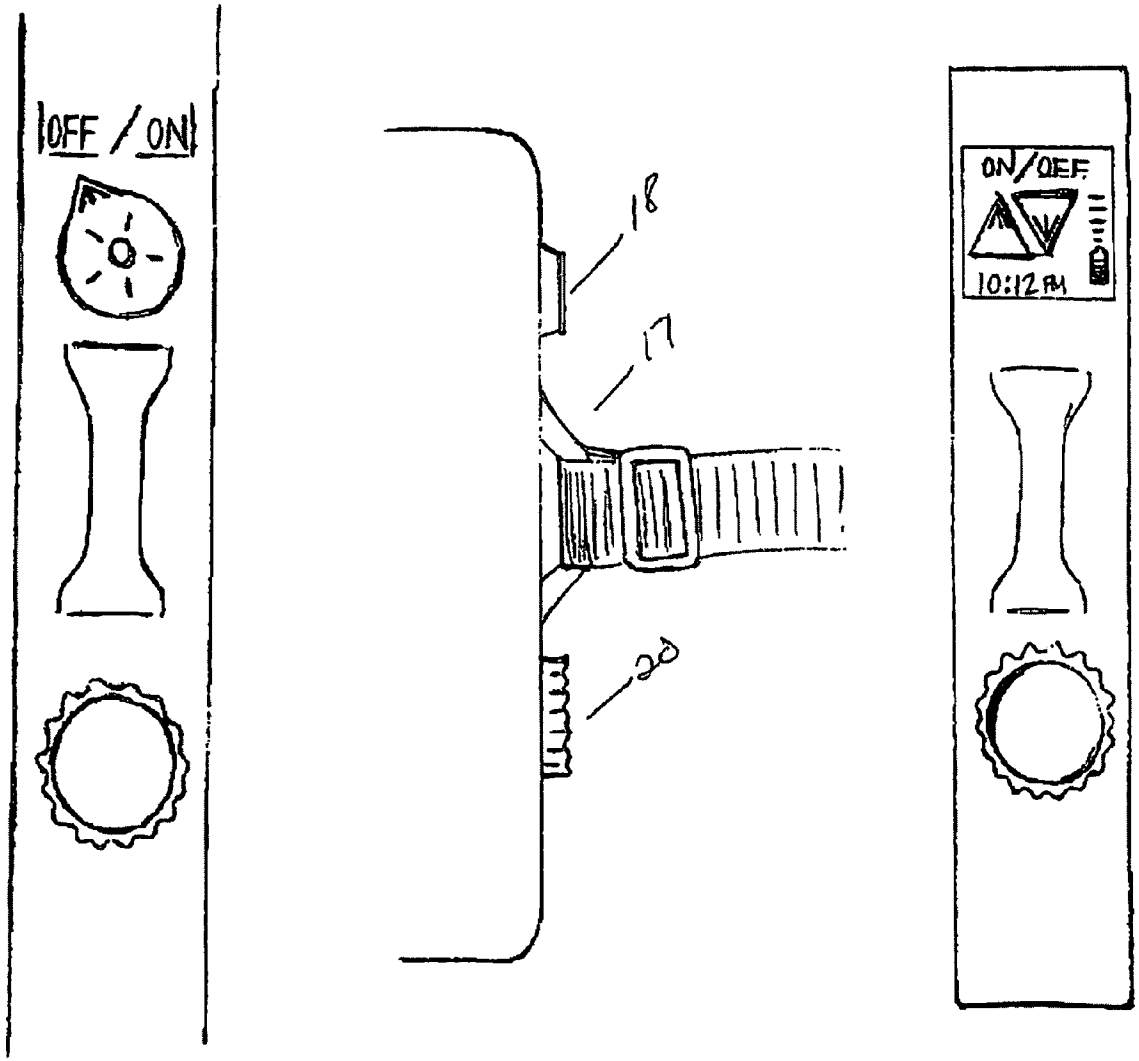
FIG. 6 shows a side view and partial front view of the handle of the portable back scrubbing and massaging device according to the present invention

Column 2, Line 47, should read, FIG. 6 shows a side view and partial front view of the strap slot 17 of the portable back scrubbing and massaging device according to the present invention.

Figure 5:
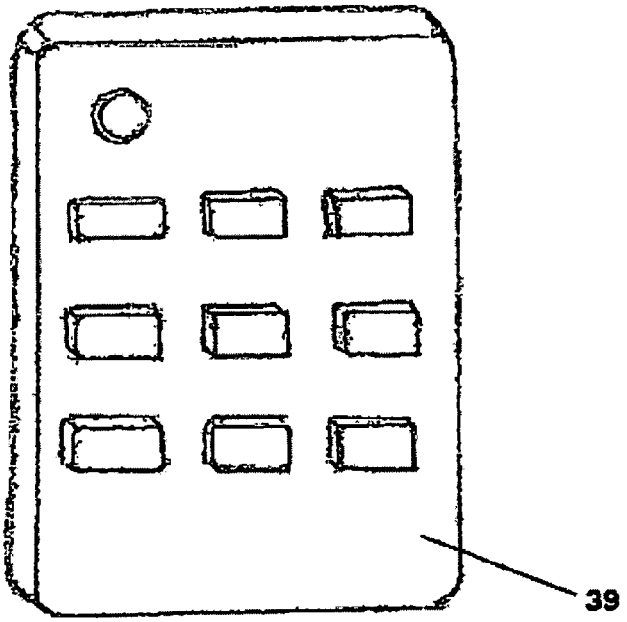
FIG. 5 shows an illustration of a generic remote digital control device.

Column 4, Lines 55-57, should read, The remote control system would comprise a remote control unit 39 as shown in FIG. 5 as indicated in the drawing.

Column 5, Lines 44-45, should read, The battery 38 is recharged via a AC adaptor 41. Shown in FIG. 3A as indicated in the drawing.

Signed and Sealed this
Tenth Day of May, 2016

Michelle K. Lee

Michelle K. Lee
*Director of the United States Patent and Trademark Office*